US010452028B2

(12) United States Patent
Heckelman

(10) Patent No.: US 10,452,028 B2
(45) Date of Patent: Oct. 22, 2019

(54) TIMEPIECE ASSEMBLY

(71) Applicant: Adam Heckelman, Weston, FL (US)

(72) Inventor: Adam Heckelman, Weston, FL (US)

( * ) Notice: Subject to any disclaimer, the term of this patent is extended or adjusted under 35 U.S.C. 154(b) by 5 days.

(21) Appl. No.: 15/609,003

(22) Filed: May 30, 2017

(65) Prior Publication Data

US 2018/0004163 A1 Jan. 4, 2018

Related U.S. Application Data

(60) Provisional application No. 62/342,692, filed on May 27, 2016.

(51) Int. Cl.
*G04B 45/02* (2006.01)
*G04B 33/14* (2006.01)
*G04B 33/08* (2006.01)

(52) U.S. Cl.
CPC ..... *G04B 45/02* (2013.01); *G04B 33/08* (2013.01); *G04B 33/14* (2013.01)

(58) Field of Classification Search
CPC ..... G04B 33/00; G04B 33/08; G04B 33/14; G04B 35/00; G04B 45/02; G09B 23/188; G09B 19/12
USPC ..... 368/45; 434/300, 304; D10/1, 40, 41
See application file for complete search history.

(56) References Cited

U.S. PATENT DOCUMENTS 4,926,401 A * 5/1990 Vuilleumier ..... G04B 37/225 368/223
2011/0228644 A1* 9/2011 Chang ..... G04B 33/08 368/127

OTHER PUBLICATIONS

Video found at the URL https://www.youtube.com/watch?&v=pLudFgsckBU uploaded on Aug. 16, 2011.*

* cited by examiner

*Primary Examiner* — Edwin A. Leon
*Assistant Examiner* — Jason M Collins
(74) *Attorney, Agent, or Firm* — Joseph R. Englander

(57) ABSTRACT

A timepiece, such as a watch, having a case, movement having an axis located within the case, gears connected to the movement, and one or more hands which may be driven by one or more gears. The gears are rotatably connected to a gear plane and are driven by the movement driving an axis extending through the gear plane. The gear plane has several connection points, such as perforations, indentations and/or protrusions, for the connection with the gears and with the hands. The gears drive the hands of the timepiece, which also include gears. The gears over the gear plane may be placed in one or more configurations to drive the hands.

11 Claims, 19 Drawing Sheets

TIMEPIECE ASSEMBLY

CLAIM OF PRIORITY BASED UPON PREVIOUSLY FILED PROVISIONAL PATENT APPLICATION

This application claims the priority of U.S. Provisional Patent Application Ser. No. 62/342,692 filed May 27, 2017.

BACKGROUND OF THE INVENTION

1. Field of the Invention

The present invention relates to a timepiece, such as a clock or watch, having a case, movement having a case and an axis located within a case, gears connected to the movement at the axis, and one or more hands which may be driven by one or more gears. The gears may be multilevel gears. The gears are rotatably connected to a gear plane and are driven by the movement driving the axis extending through the gear plane. The gear plane has several connection points, such as perforations, indentations and/or protrusions, for the connection with the gears and with the hands. The movement is located below the gear plane. The gears drive the hands of the timepiece, which may also include gears. The gears on the gear plane may be placed in one or more configurations to drive the hands. The gear plane also may be movable or removable, to provide access to the movement and the area between the gear plane and the bottom surface of the case. Each gear may also vary in size, color, number and size of teeth, gear levels and/or other elements. A gear may have one or more configurations on each axis so that the gears are meshable at multiple levels. The hands may be offset from the axis of the movement. A movable or removable transparent cover may also be located at the top portion of the case.

2. Description of the Related Art

A general problem with timepieces is that they are static in nature. Once designed they are difficult to redesign.

Also, the mechanisms within a timepiece are difficult to observe, and having many of the gears in sight may inspire the user to learn about engineering disciplines. Furthermore, having gears which may be easily changed into different configurations and colors may inspire artistic notions in the user.

SUMMARY OF THE INVENTION

The present invention is intended to provide a timepiece that is inspirational, educational and decorative. The gears and hands may be easily accessed for adding or subtracting gears, or for change or reconfiguration of the gears. Furthermore, the gears may be of modular construction for ease of manufacture.

Another aim of the present invention is to provide such a modular construction of the gears and hands so they may be removed and replaced and reconfigured In order to afford the additional possibility of creative endeavor, the gear plane upon which the gears and hands are connected may also be moved or replaced. This gear plane may be transparent to allow the user to see through to portions of the timepiece below the gear plane.

Moreover, in order to facilitate the coupling of the hands with the gears, the hands may be located on a projection on the gear plane while the driving gears are located on perforations in the gear plane, or vice versa.

Thus, it is possible to assemble and reconfigure the timepiece parts in a quickly and easily.

The user may have numerous possibilities in configuring the gears and hands where the gear plane includes multiple connection points so that the gears and hands may be located in several places in the gear plane.

Another potential use for the present invention is the incorporation of multiple different designs on the gear plane based upon different configurations of the gears.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated are examples. It is understood that the invention is not limited to the precise arrangements and instrumentalities shown, wherein.

DETAILED DESCRIPTION OF THE INVENTION

FIGS. 1-5 show an exemplary embodiment of an assembly of a timepiece 10 of the present invention. The timepiece may be a clock, watch or other mechanism showing rotational movement on a planar face.

Figure 1:
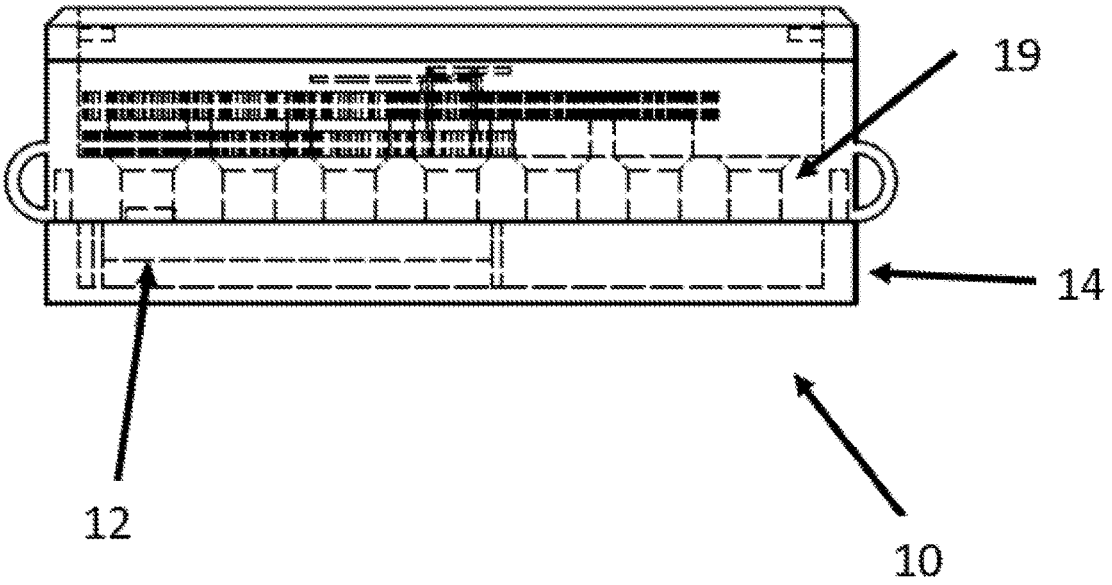
FIG. 1 is a top view of one embodiment of the invention.
Figure 2:
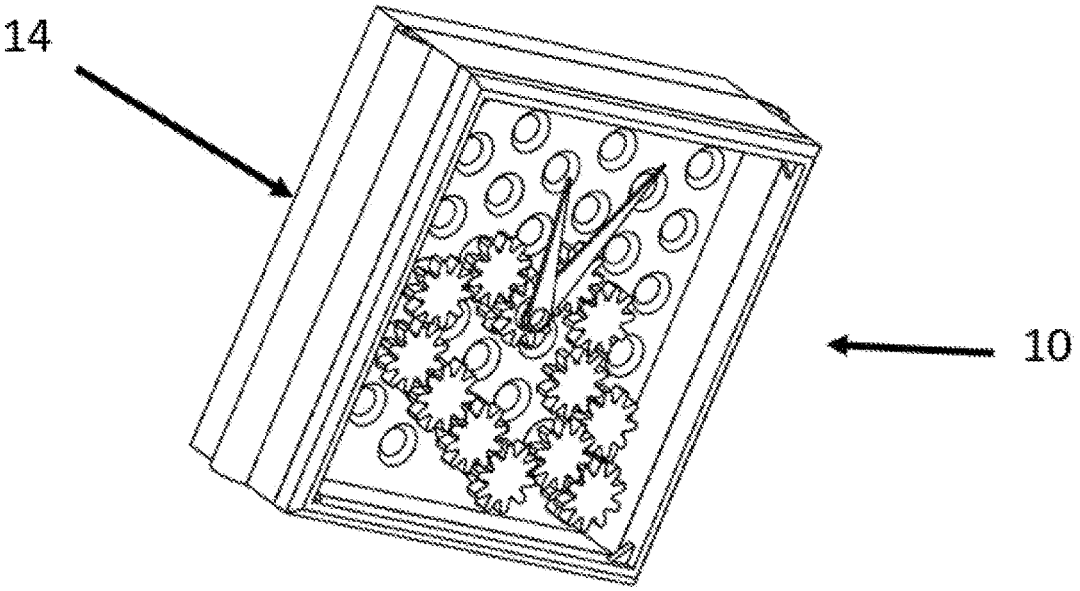
FIG. 2 is a perspective view of one embodiment of the invention.
Figure 3:
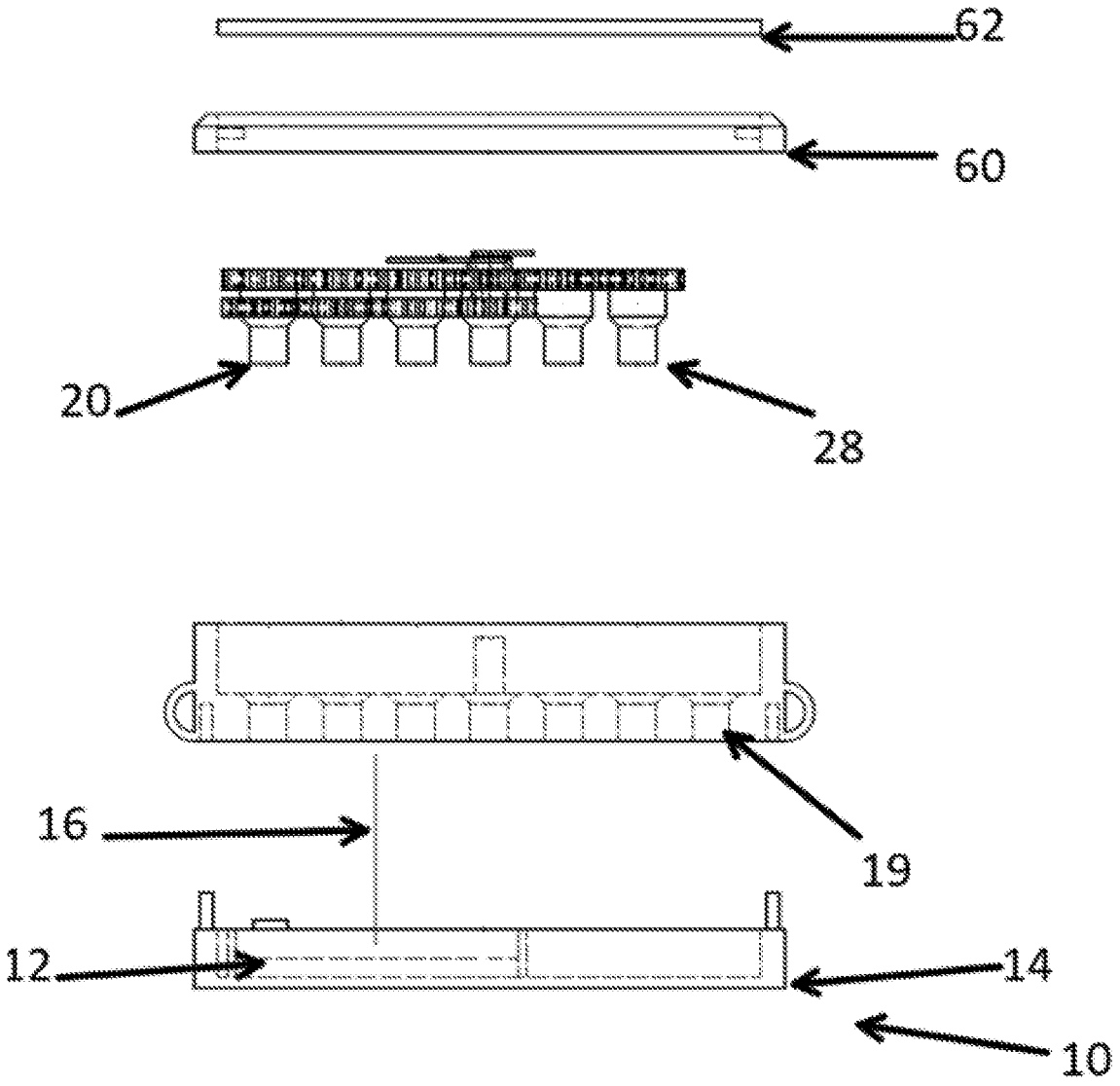
FIG. 3 is a side view of one embodiment of the invention.
Figure 6:
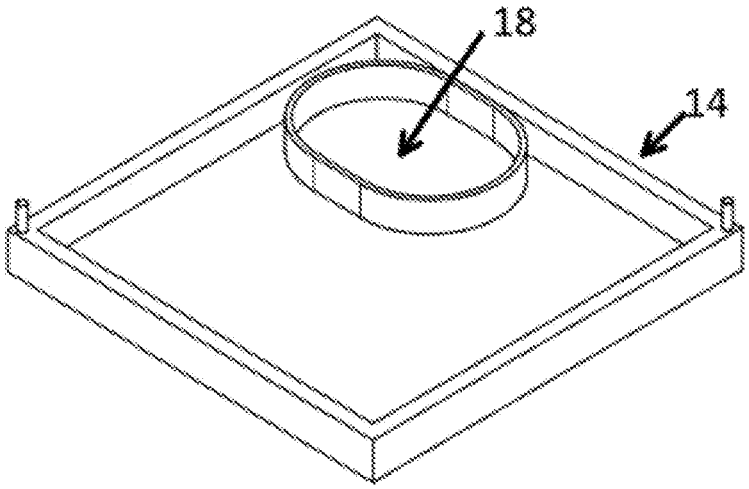
FIG. 6 is a perspective view of a case of one embodiment of the invention.

As shown in FIGS. 1-3, the timepiece 10 includes timepiece movement 12 located in a bottom case 14. The timepiece movement 12 is connected to a movement axis 16 extending radially from the timepiece movement 12. As shown in FIG. 6, the bottom case 14 may have a timepiece movement area 18, for securing the timepiece movement 12 within the timepiece 10.

Figure 7:
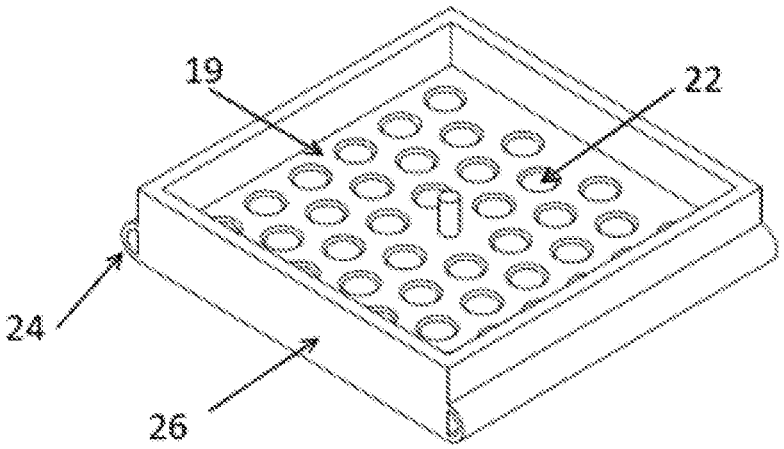
FIG. 7 is a perspective view of a gear plane of one embodiment of the invention.
Figure 8:
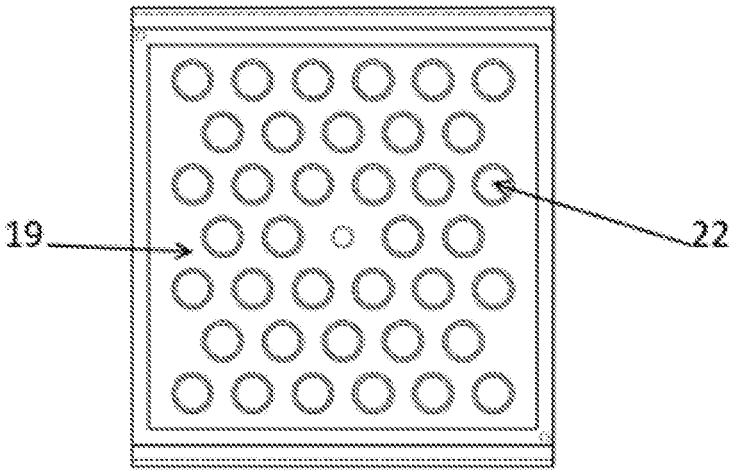
FIG. 8 is a top view of a gear plane of one embodiment of the invention.
Figure 9:
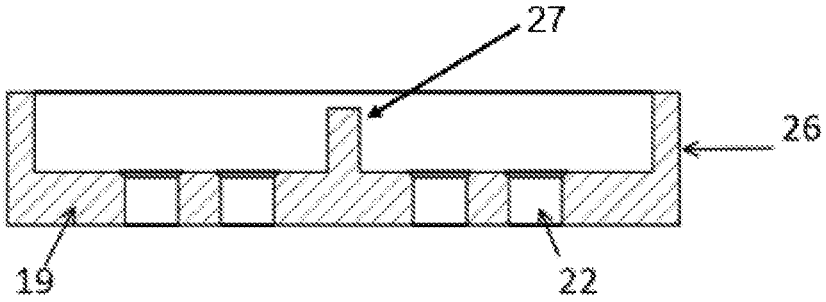
FIG. 9 is a side view of a gear plane of one embodiment of the invention.

The movement axis 16 passes through a generally parallel gear plane 19 to connect radially with a drive gear 20 and drive the drive gear 20. The gear plane 19 is illustrated in FIGS. 7-9. The gear plane 19 includes a plurality of axis connection points 22. The axis connection points 22 may be perforations, indentations and/or protrusions for the placement of gear axes as described herein. The connection points may be formed in an array as shown.

One or more display connection points 24 may also be included on the gear plane 19. The display connection points 24 may be used to connect the timepiece 10 with a wristband, picture hooks or other means for displaying the timepiece. The gear plane 19 may also include an outer wall 26. Axis connection points may also be included on the bottom case.

Figure 4:
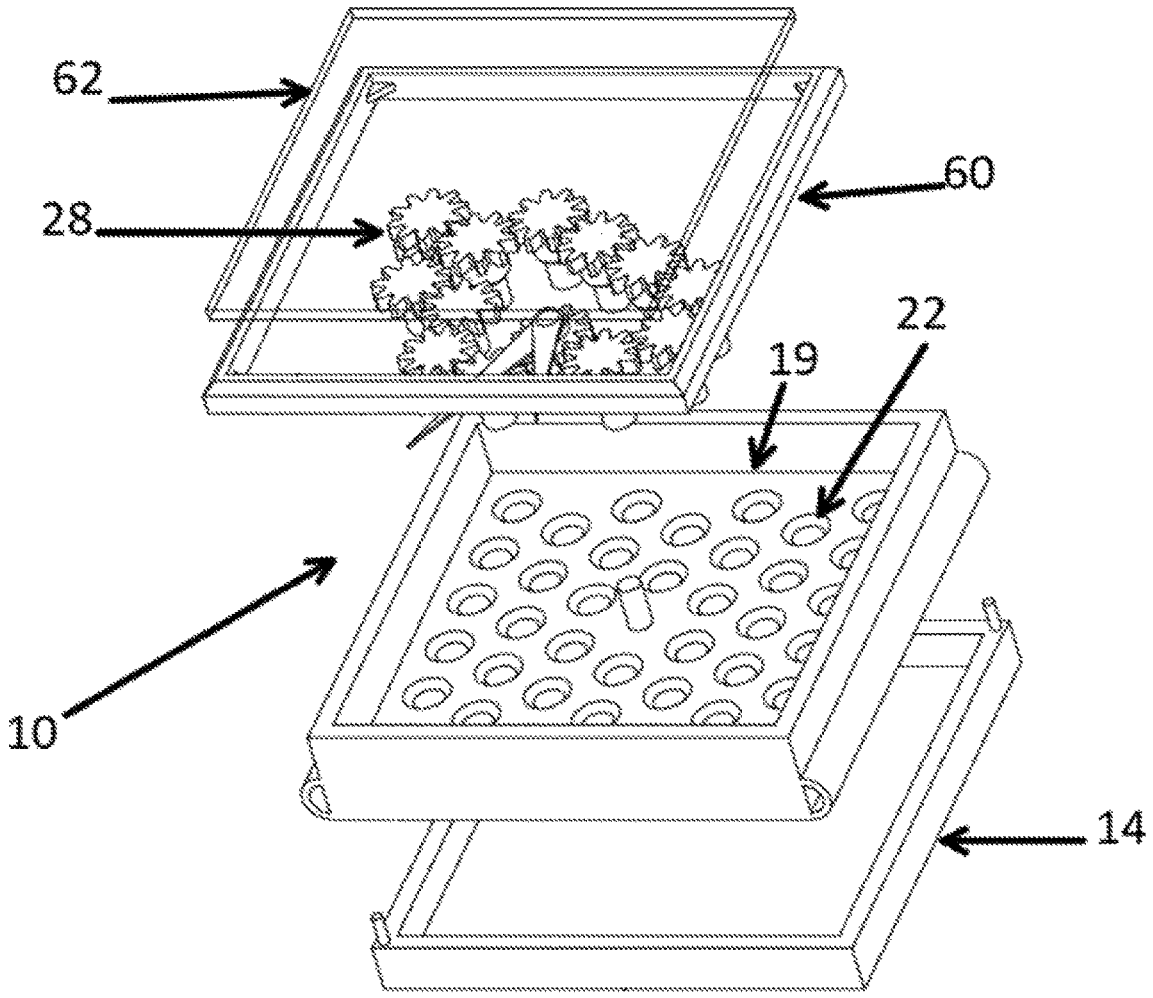
FIG. 4 is a side exploded view of one embodiment of the invention.
Figure 5:
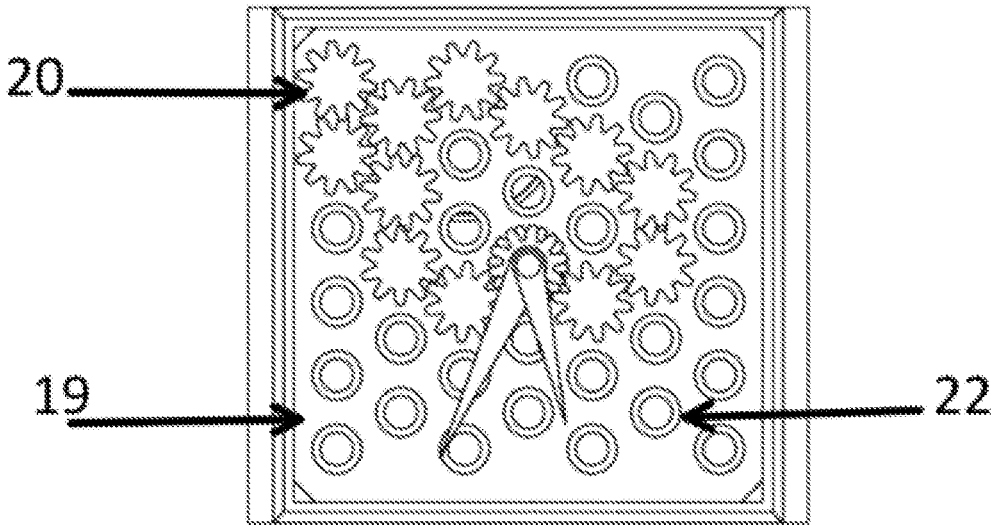
FIG. 5 is a perspective exploded view of one embodiment of the invention.
Figure 10:
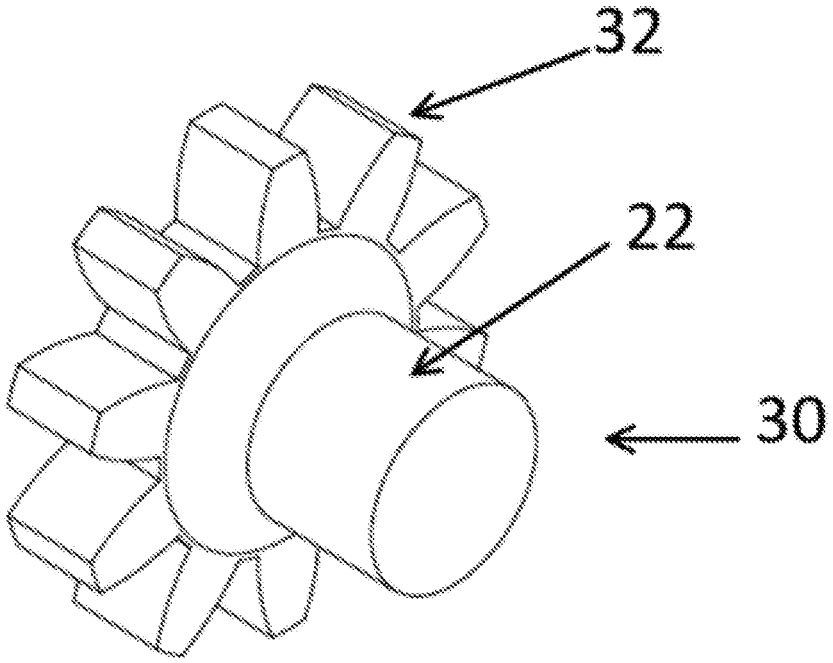
FIG. 10 is a perspective view of a short gear of one embodiment of the invention.
Figure 11:
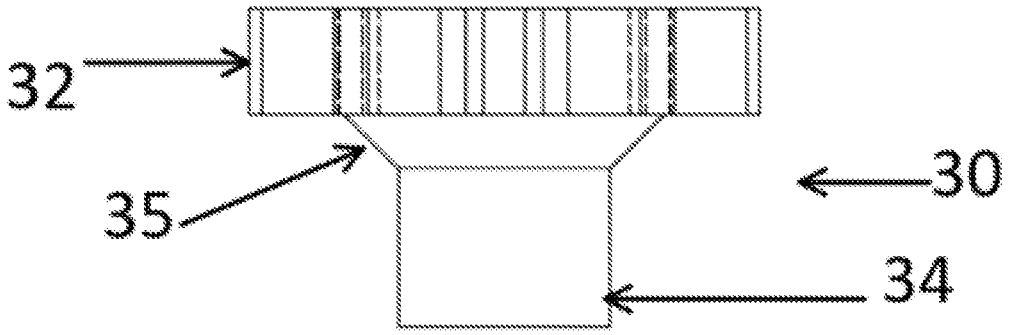
FIG. 11 is a side view of a short gear of one embodiment of the invention.
Figure 12:
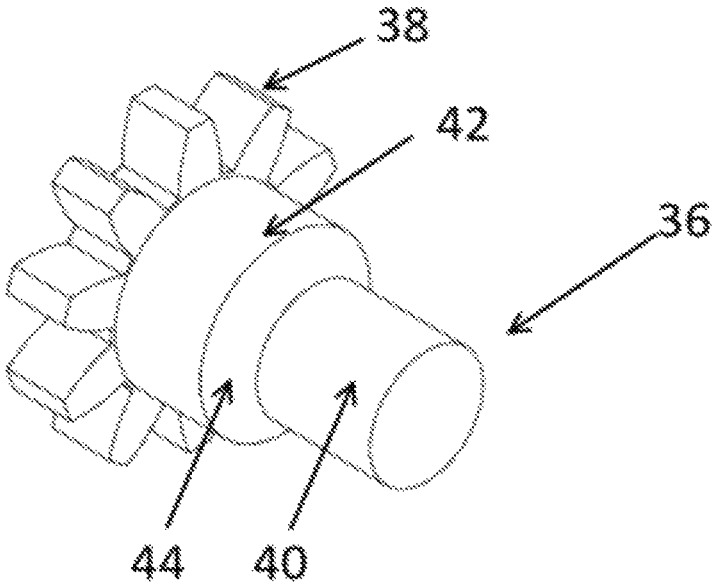
FIG. 12 is a perspective view of a long gear of one embodiment of the invention.
Figure 13:
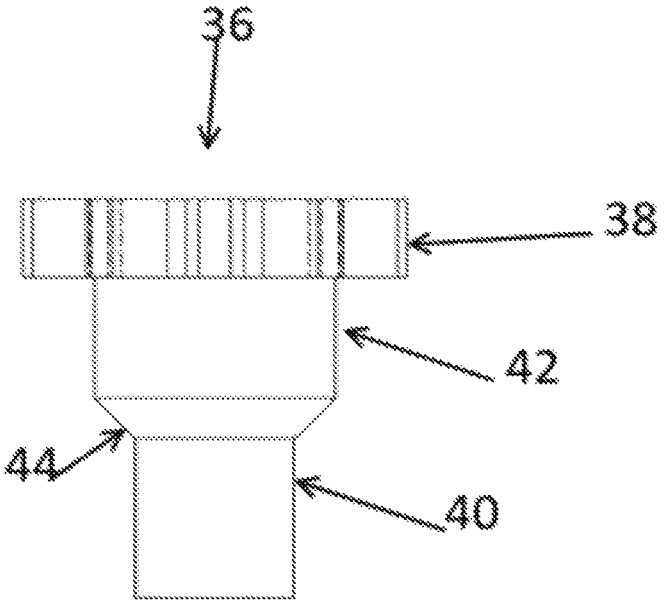
FIG. 13 is a side view of a long gear of one embodiment of the invention.

As shown in FIGS. 4 and 5, one or more gears 28 are placed in the gear plane 19 in meshed rotatable connection with the drive gear 20. Several types of gears 28 are contemplated for this invention, examples of which are shown in FIGS. 10-15. The invention may include gears 28 having varied and/or multiple gear heads or shafts of varying height. FIGS. 10 and 11 illustrate a short gear 30, having a short gear head 32 on a short gear shaft 34. The short gear shaft may include a short gear shaft taper 35. FIGS. 12 and 13 illustrate a long gear 36, having a long gear head 38 on a long gear shaft 40. The long gear shaft 40 may include a long gear shaft bulge 42 which may further include a long gear shaft taper 44 away from the long gear head 38. The short gear shaft taper 35 and the long gear shaft taper 44 allow the gears to turn more easily in the connection points 24. In an alternative embodiment, long or short gear shafts may be in rotational connection with axis connection points located on the bottom case.

Figure 14:
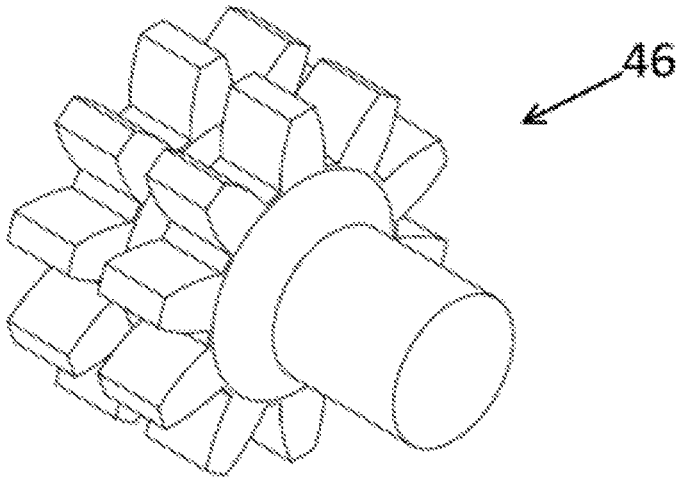
FIG. 14 is a perspective view of a double gear of one embodiment of the invention.
Figure 15:
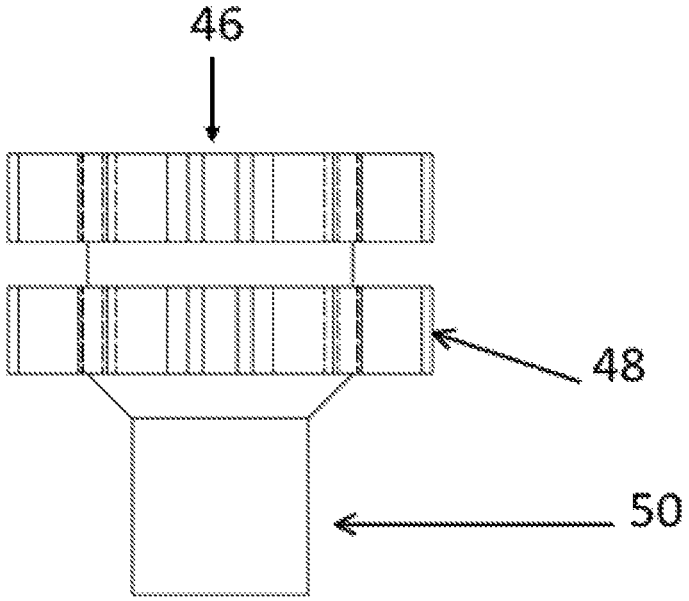
FIG. 15 is a side view of a double gear of one embodiment of the invention.

FIGS. 14 and 15 illustrate a multiple gear 46, having a multiple gear head 48 on a multiple gear shaft 50. As shown in FIGS. 4 and 5, the multiple gear head 48 may allow interaction a between one or more short gears 30 and long gears 36, as well as additional multiple gears 46. In addition the multiple gear head 48 may include two or more gears of varying diameter. Although two levels of gears are shown, several layers of gears are contemplated for the multiple gear 46 of the invention.

Furthermore, as illustrated in FIGS. 1-5, the short gear shaft 34, the long gear shaft 40 and the multiple gear shaft 50 are shown to be complementary to the connection points 22 shown to be perforations in the gear plane 19. However, the connection points 22 may have other geometrical configuration, such as indentations or protrusions, in which case the gear shafts would have complementary geometry such as voids or indentations.

Figure 16:
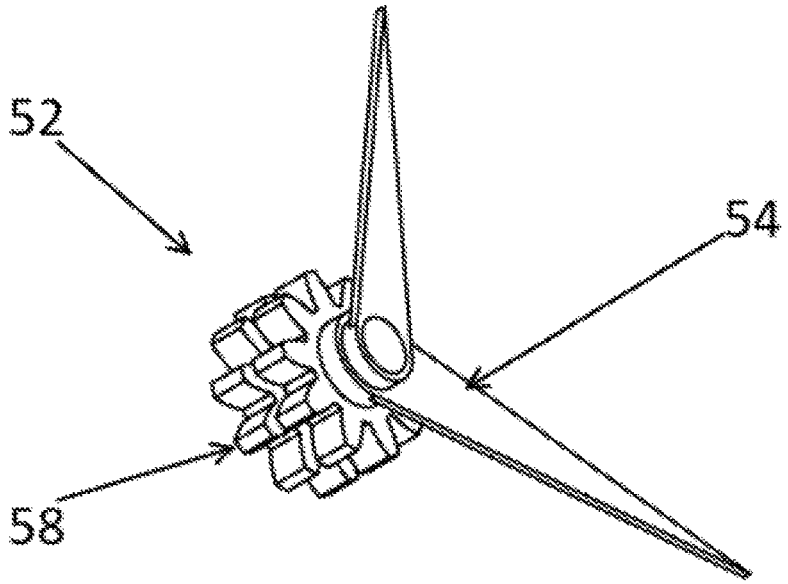
FIG. 16 is a perspective view of hands of one embodiment of the invention.
Figure 17:
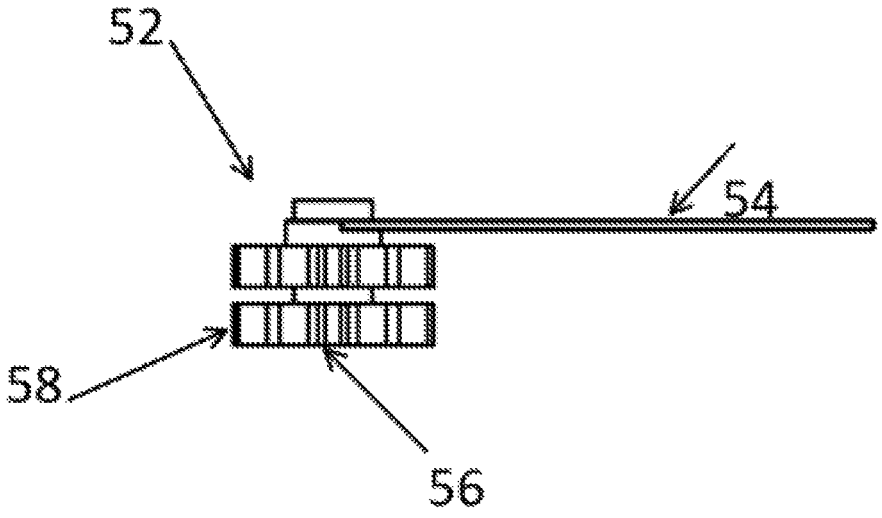
FIG. 17 is a side view of hands of one embodiment of the invention.

Also located on the gear plane 19 is a hand gear 52. As shown in FIGS. 16 and 17, the hand gear 52 includes one or more hands 54 and an indentation 56 complementary to the hand connection point 24 on the gear plane 19. The hand gear 52 further includes a hand gear head 58. Although the hand gear head 58 is shown to have multiple levels, the hand gear head 58 may have a single level of gearing. As with the connection between the gears and the gear plane described above, although a protrusion is shown for connection between the gear plane 19 and the hand gear 52, other connection mechanisms between the gear plane 19 and the hand gear 52 are also contemplated.

Figure 18:
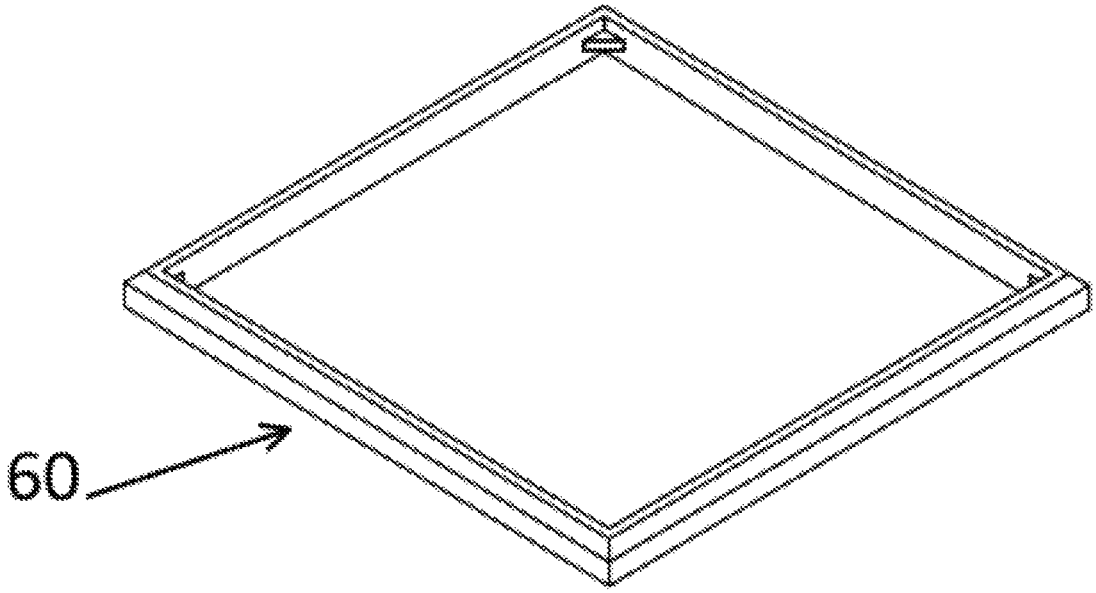
FIG. 18 is a perspective view of a gear frame of one embodiment of the invention.
Figure 19:
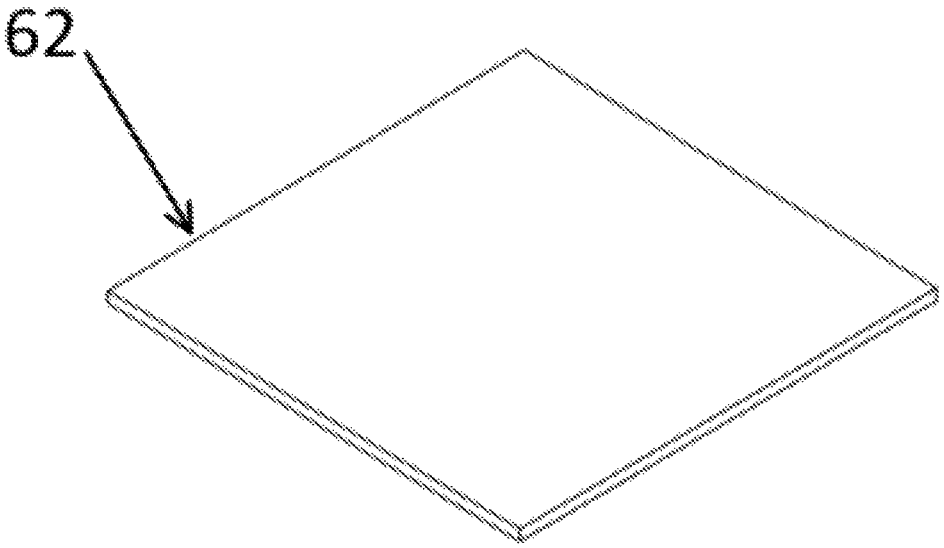
FIG. 19 is a perspective view of a cover frame of one embodiment of the invention.
Figure 21:
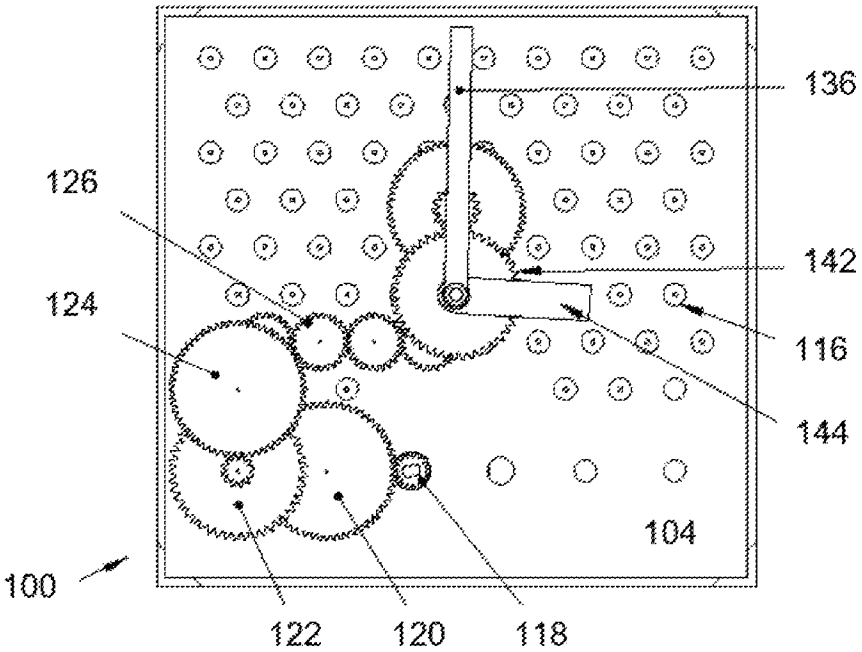
FIG. 21 is a top view of an embodiment of the invention.
Figure 20:
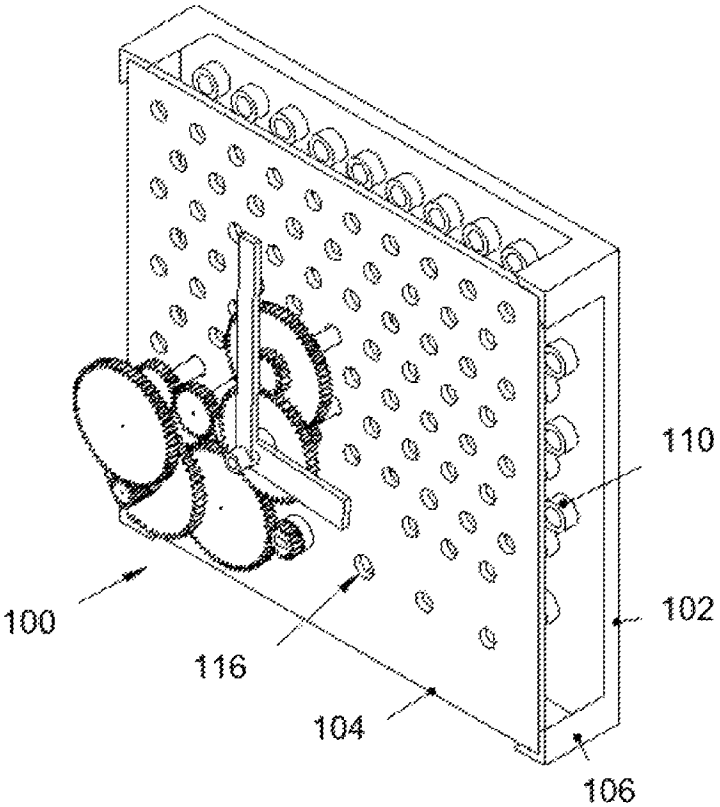
FIG. 20 is a perspective view of an embodiment of the invention.

As shown in FIGS. 5, 18 and 19, the timepiece 10 may also include a cover frame 60 and cover 62. The cover is translucent or transparent to show the gear plane 19 and the working of the mechanisms on the gear plane 19.

In operation, the timepiece movement drives the drive gear. The drive gear interacts with other gears connected to the gear plane at gear connection points. The gear plane also helps to secure the timepiece movement within the case. Gears driven by the drive gear in turn drive the hand gear to move the hands to show the time. The gears may me moved and/or rearranged around the gear plane as desired by the user. The gears may interact at different levels within the timepiece based upon the usage of multiple level gear heads. For example, a short gear may interact with a multiple gear, which may interact with a long gear, which may interact with another multiple gear. Gears of differing sizes, colors, shapes and configuration may be used. In addition, the gear plane may be moved or removed so that a user may access the timepiece movement or the area in the case under the gear plane.

Another embodiment of the invention is described in FIGS. 20-24. A timepiece assembly 100 is illustrated. The timepiece assembly 100 includes a lower level base 102 and a frame 104 in mechanical connection with the lower level base 102. The lower level base may include a plurality of braces 106 to connect the lower level base 102 with the frame 104. Other means for spacing the lower level base 102 from the frame 104 are also contemplated.

Figure 24:
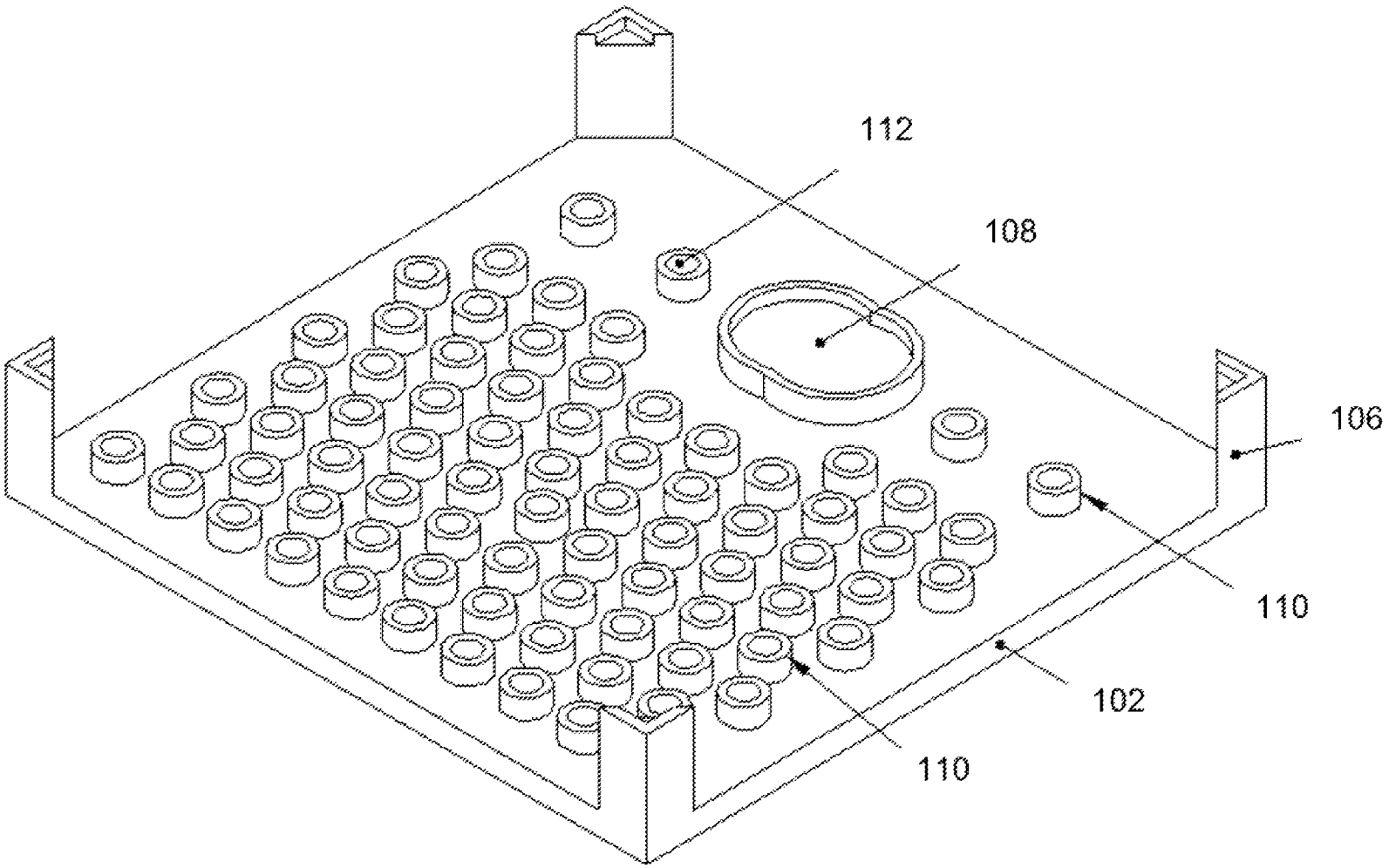
FIG. 24 is a perspective view of a lower level of the invention.
Figure 26:
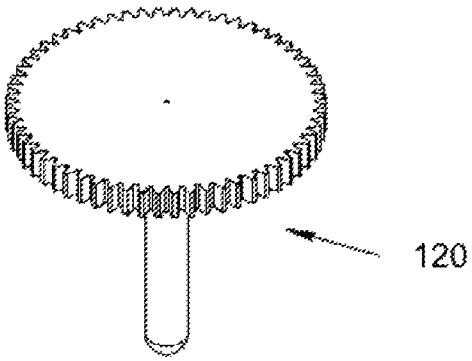
FIG. 26 is a perspective view of a gear of the invention.

As shown in FIG. 24, the lower level base 102 may include a motor containment area 108 and one or more axis containment points 110. As shown, the axis connection points 110 are indentations 112 in the lower level base 102 that would be complementary to axes or protrusions in one or more gears. The axis connection points 110 may be formed in an array such as the one shown. The axis connection points 110 may alternatively be protrusions complementary to indentations in corresponding axes in one or more gears. A motor 114 is located in the motor containment area 108 and is held in place by the upper frame 104.

The frame 104 includes one or more voids 116 which correspond to the axis connection points in the lower level base 102. The voids 116 may be formed in an array as shown, corresponding to the array of axis containment points 110. As described below, one or more gears having axes are placed through the voids 116 so that the axes are in rotatable connection with the axis connection points 110 and gear heads turn above the frame 104.

Figure 25:
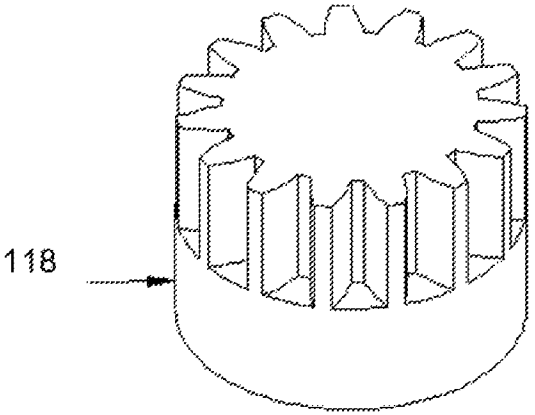
FIG. 25 is a perspective view of a gear of the invention.
Figure 27:
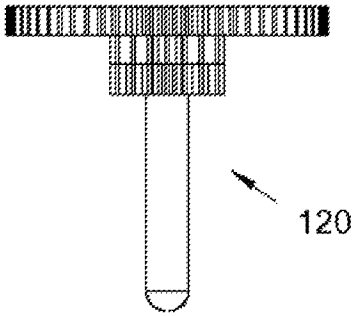
FIG. 27 is a side view of a compound gear of the invention.
Figure 29:
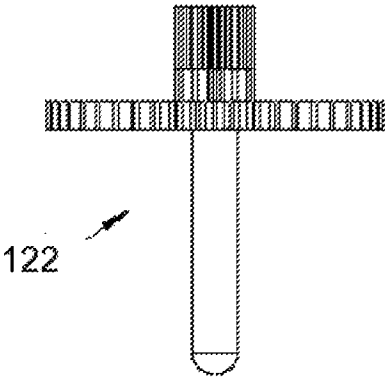
FIG. 29 is a side view of a compound gear of the invention.

The motor 114 drives a motor axis which may be part of the motor or attached to the motor. The motor axis extends from the motor 114 through a void 116 above the motor 114 and extends above the frame 104. The motor axis is connected to a motor gear head 118 such as the one illustrated in FIG. 25. The motor gear head 118 in turn drives one or more dependent gears which may be rearranged to be placed in different voids 116 in the frame 104. Gears of various sizes and compound complexity may be added or removed in positions around the frame 104 while still in mechanical connection with the motor gear head 118.

Figure 22:
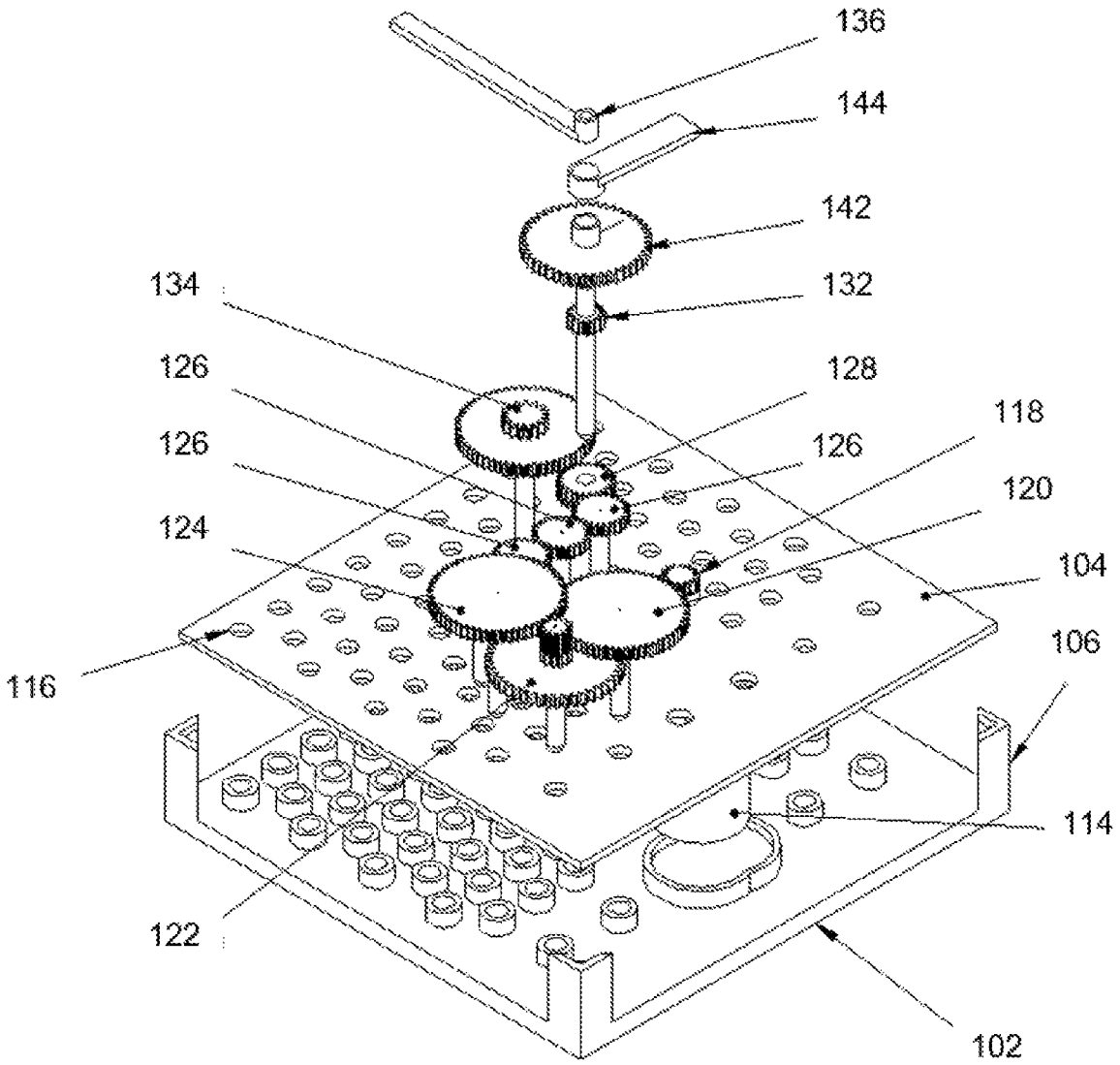
FIG. 22 is an exploded view of an embodiment of the invention.
Figure 23:
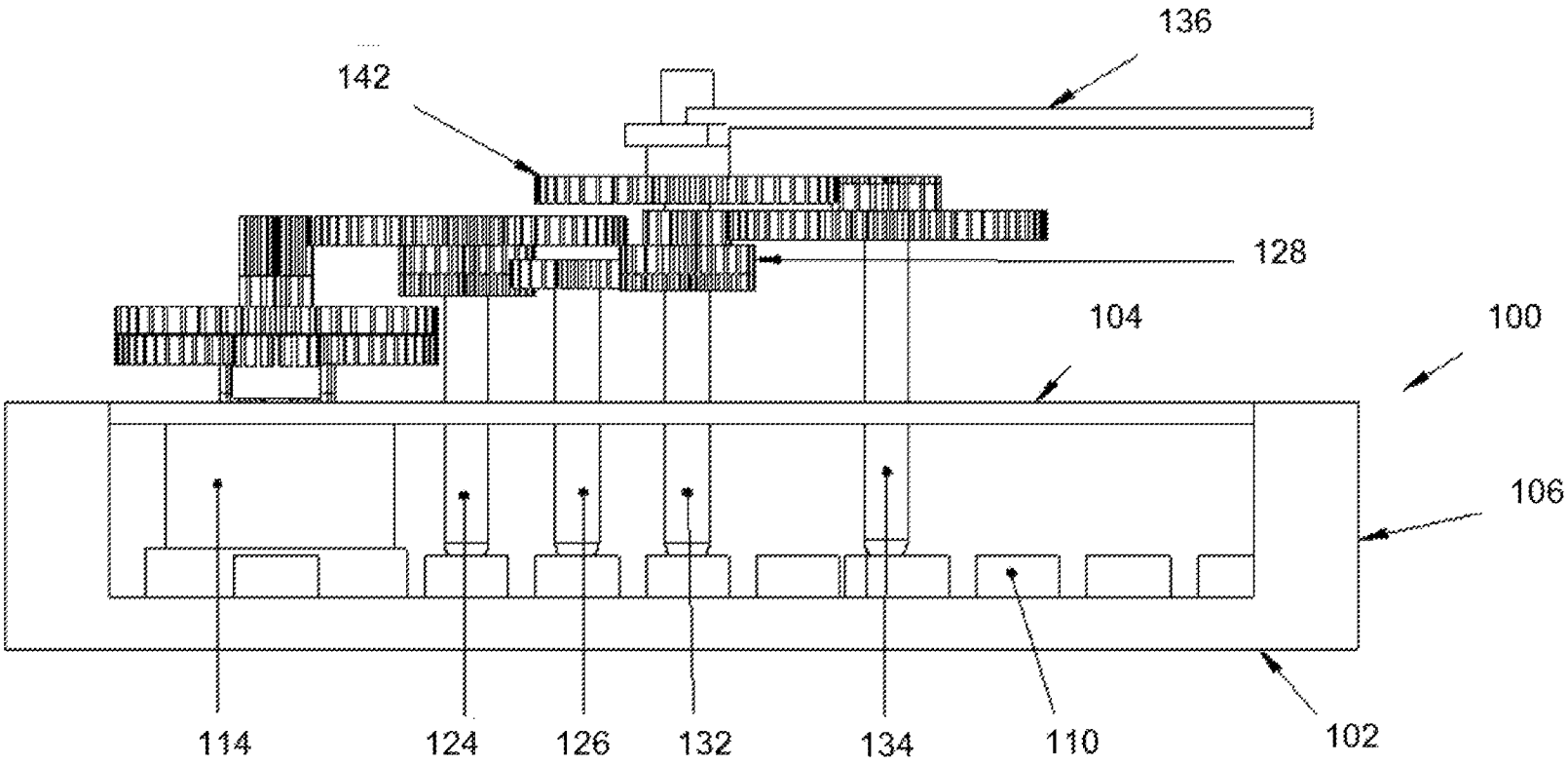
FIG. 23 is a side view of an embodiment of the invention.
Figure 31:
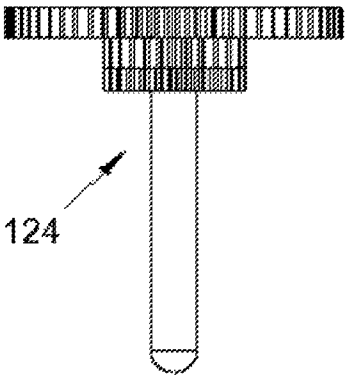
FIG. 31 is a side view of a compound transfer gear of the invention.
Figure 28:
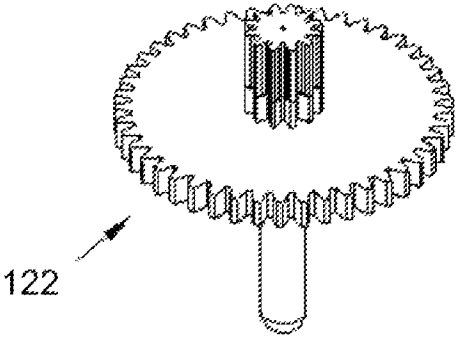
FIG. 28 is a perspective view of a compound gear of the invention.
Figure 30:
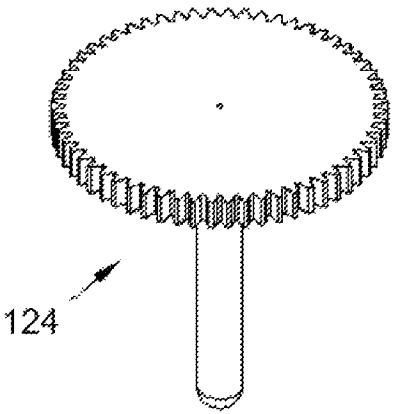
FIG. 30 is a perspective view of a compound transfer gear of the invention.
Figure 33:
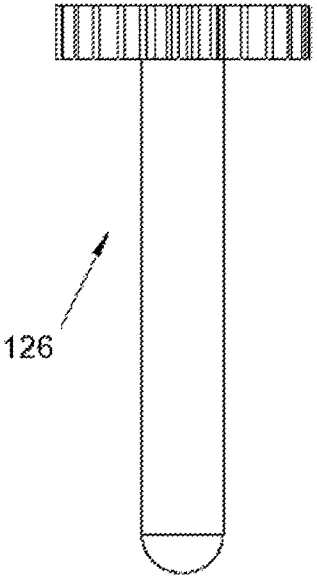
FIG. 33 is a side view of a transfer gear of the invention.
Figure 32:
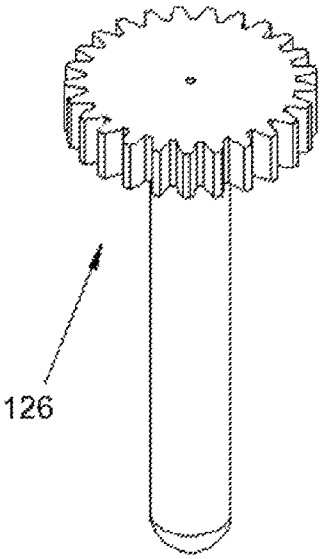
FIG. 32 is a perspective view of a transfer gear of the invention.
Figure 34:
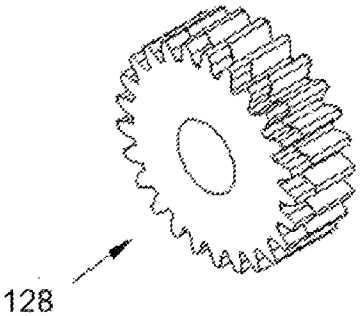
FIG. 34 is a perspective view of a timing gear of the invention.
Figure 35:
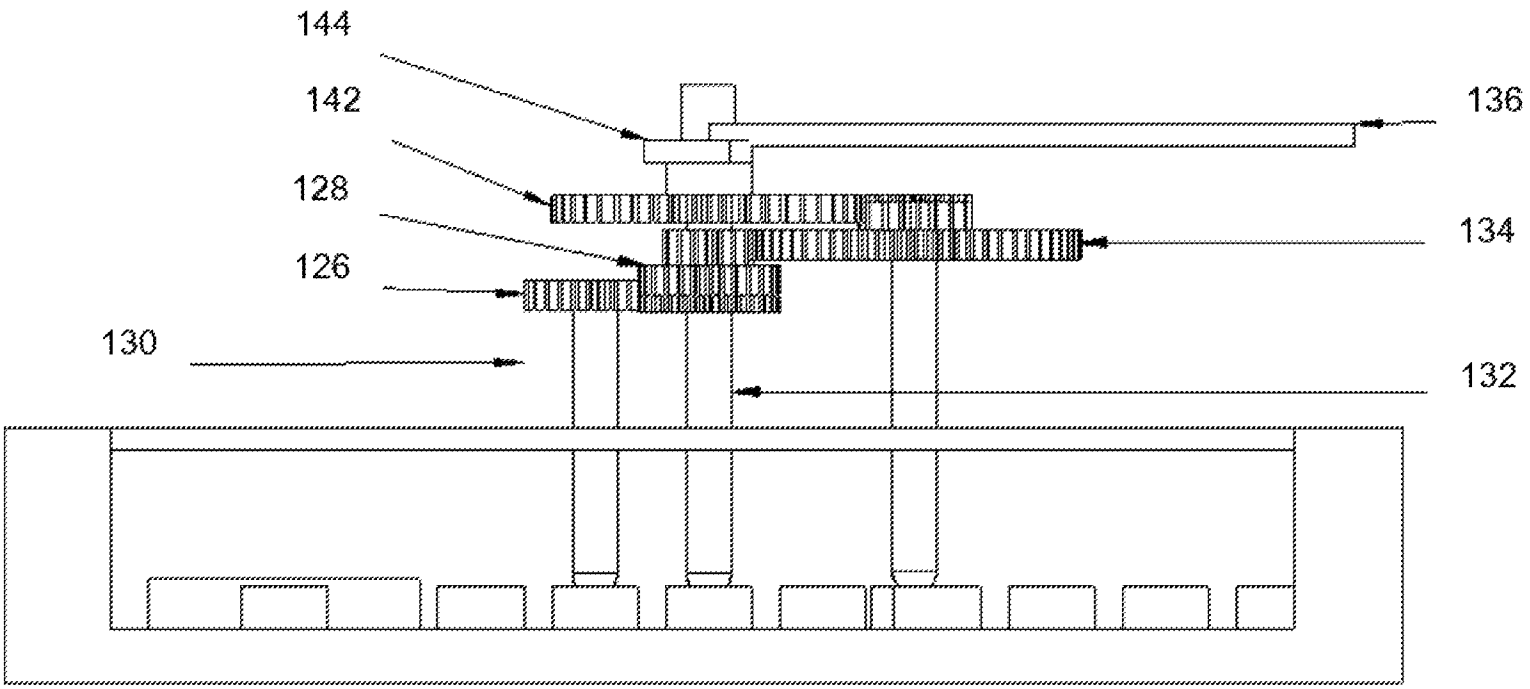
FIG. 35 is a side view of the clock assembly portion of the invention.

In the embodiment illustrated in FIG. 22, various different subordinate gears are driven by the motor gear head 118. The gears of one embodiment of the present invention are shown in FIG. 26 through 36. The motor gear head 118 drives a first compound gear 120 such as one shown in FIGS. 26 and 27. The first compound gear may drive a second compound gear 122 such as the one shown in FIGS. 28 and 29. The second compound gear 122 then may drive a first transfer compound gear 124 as shown in FIGS. 30 and 31. The first compound transfer gear then may drive one or more secondary transfer gears 126, such as the one shown in FIGS. 32 and 33. As shown in the figures, a secondary transfer gear may in turn drive a timing gear 128, such as the one shown in FIG. 34 having 25 teeth. The timing gear 128 may in turn drive a clock gear assembly 130 shown in FIG. 35.

Figure 37:
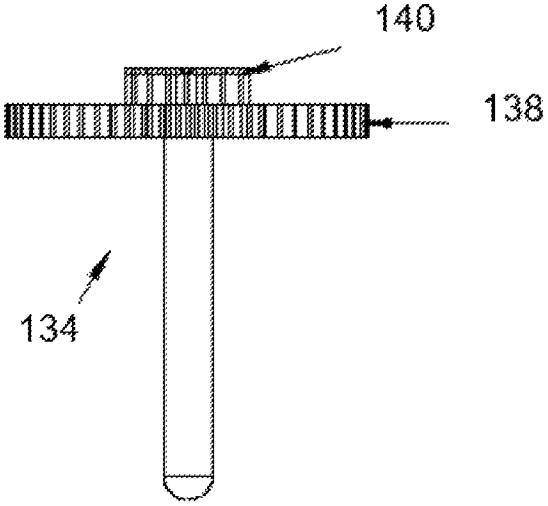
FIG. 37 is a side view of a cog of the invention.
Figure 36:
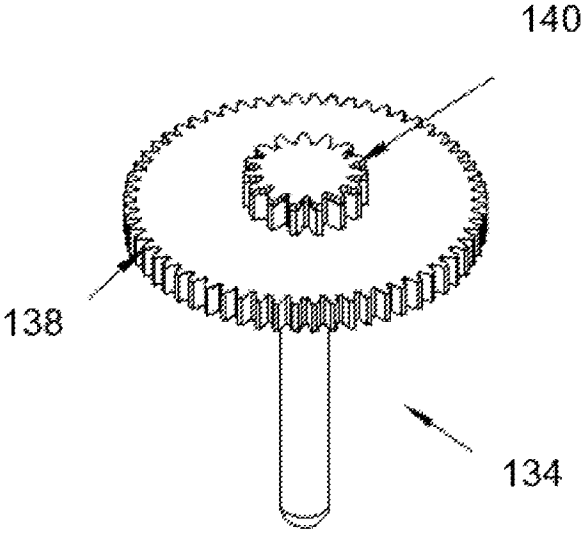
FIG. 36 is a perspective view of a cog the invention.

As shown, the timing gear 128 is mechanically connected to an axle gear 132. The axle gear 132 transfers motion to a cog gear 134 as shown in FIGS. 36 and 37 as well as rotates a minute hand 136 connected to the axle gear 132. The cog gear 134 having a primary cog wheel 138 and a secondary cog wheel 140. Motion from the secondary cog wheel 140 may then be transferred to an hour hand gear 142 which rotates an hour hand 144 at an appropriate rate.

It is important to note that the gears and axles of the invention have each have axes which pass through the voids in the frame to be in rotational connection with the axis connection points on the lower level base. Additional gears and axis may be included which are placed in corresponding voids and axis connection points. Furthermore, the gears and axes described herein may be moved around the frame and still interconnect so that any one of several configurations are possible to drive the gears and hands.

It will be appreciated by persons skilled in the art that the present invention is not limited to what has been particularly shown and described herein above. In addition, unless mention was made above to the contrary, it should be noted that the accompanying drawings are not to scale. A variety of modifications and variations are possible in light of the above teachings without departing from the scope and spirit of the invention.

What is claimed is:

1. A timepiece assembly, comprising:

a bottom case, having a motor containment area;

a gear plane connected to and generally parallel to the bottom case, the gear plane including an array of axis connection points comprising at least in part an evenly spaced two dimensional array of axis connection points;

a timepiece movement motor located at the motor containment area having a drive motor axis in fixed connection with a motor gear, wherein the drive motor axis passes through an axis connection point; and a plurality of gears in mechanical connection with the motor gear and in rotational connection with a plurality of corresponding axis connection points;

wherein the axis connection points comprise at least one of perforations, indentations and protrusions;

wherein the plurality of gears includes gears having multiple gear heads and shafts of varying height;

wherein the plurality of gears are addable on the gear plane, movable on the gear plane and removable from the gear plane while providing for rotational movement of the plurality of gears.

2. The timepiece assembly of claim 1, further including one or more display connection points located on the gear plane.

3. The timepiece assembly of claim 1, wherein the plurality of gears includes at least one multiple gear having a multiple gear head on a multiple gear shaft, wherein the multiple gear head interacts with one or more short gears and long gears longer in length than the short gears.

4. The timepiece assembly of claim 3, further comprising one or more hand gears in mechanical connection with at least one of the plurality of gears.

5. The timepiece assembly of claim 3, further comprising:

a cover frame connected to the gear plane, and a cover attached to the cover frame, wherein the cover frame is in movable connection with the gear plane.

6. The timepiece assembly of claim 1, wherein the gear plane is in movable connection with the bottom case.

7. A timepiece assembly, comprising:

a lower level base having one or more axis containment points in a first array;

a frame in mechanical connection with the lower level base having one or more voids in a second array complementary to the axis connection points;

a motor located on the lower level base, said motor in mechanical connection with a drive axis extending through a void in the frame corresponding to the motor;

a drive gear head connected to the drive axis located above the frame; and a plurality of gears in mechanical connection with the drive gear, the plurality of gears having axes wherein the plurality of gear heads are located, above the frame and the respective axes extend through the voids to respective axis connection points in the lower level base.

8. The timepiece assembly of claim 7, wherein the plurality of gears are in mechanical connection with a clock gear assembly.

9. The timepiece assembly of claim 8, wherein additional gears may be located over voids in the frame and in mechanical connection with the clock gear assembly.

10. The timepiece assembly of claim 8, wherein the location of the plurality of gears may be rearranged on the frame and still be in connection with the clock gear assembly.

11. The timepiece assembly of claim 10, wherein additional gears may be added over voids in the frame in mechanical connection with the drive gear.

* * * * *